US010262644B2

(12) United States Patent
Leistikow et al.

(10) Patent No.: US 10,262,644 B2
(45) Date of Patent: Apr. 16, 2019

(54) COMPUTATIONALLY-ASSISTED MUSICAL SEQUENCING AND/OR COMPOSITION TECHNIQUES FOR SOCIAL MUSIC CHALLENGE OR COMPETITION

(71) Applicant: Smule, Inc., San Francicso, CA (US)

(72) Inventors: Randal Leistikow, San Jose, CA (US); Mark Godfrey, Atlanta, GA (US); Ian S. Simon, San Francisco, CA (US); Jeannie Yang, San Jose, CA (US); Michael W. Allen, San Carlos, CA (US)

(73) Assignee: Smule, Inc., San Francisco, CA (US)

( * ) Notice: Subject to any disclaimer, the term of this patent is extended or adjusted under 35 U.S.C. 154(b) by 0 days.

(21) Appl. No.: 14/587,625

(22) Filed: Dec. 31, 2014

(65) Prior Publication Data

US 2015/0120308 A1 Apr. 30, 2015

Related U.S. Application Data

(63) Continuation-in-part of application No. 13/853,759, filed on Mar. 29, 2013.

(Continued)

(51) Int. Cl.
*G10L 21/055* (2013.01)
*G10H 1/36* (2006.01)

(Continued)

(52) U.S. Cl.
CPC ..... *G10H 1/366* (2013.01); *G10L 21/00* (2013.01); *G10H 2210/051* (2013.01);

(Continued)

(58) Field of Classification Search
CPC ..... G10L 21/01; G10L 21/055; G10H 1/36; G10H 1/366; G10H 2210/101; G10H 2210/105; G10H 2240/031

(Continued)

(56) References Cited

U.S. PATENT DOCUMENTS 5,867,816 A * 2/1999 Nussbaum ..... G10L 15/063 704/232
8,005,666 B2 * 8/2011 Goto ..... G10L 15/26 704/207

(Continued)

FOREIGN PATENT DOCUMENTS

CN 101399036 A 4/2009

OTHER PUBLICATIONS

Oytun Turk et al.; "Application of Voice Conversion for Cross-Language Rap Singing Transformation", Acoutics, Speech and Signal Processing Conference Proceedings, 2009, ICASSP 2009, IEEE International Conference, IEEE, Piscataway, NJ, USA, Apr. 19, 2009, pp. 3597-3600.

(Continued)

*Primary Examiner* — Martin Lerner
(74) *Attorney, Agent, or Firm* — Haynes and Boone, LLP

(57) ABSTRACT

An application that manipulates audio (or audiovisual) content, automated music creation technologies may be employed to generate new musical content using digital signal processing software hosted on handheld and/or server (or cloud-based) compute platforms to intelligently process and combine a set of audio content captured and submitted by users of modern mobile phones or other handheld compute platforms. The user-submitted recordings may contain speech, singing, musical instruments, or a wide variety of other sound sources, and the recordings may optionally be preprocessed by the handheld devices prior to submission.

12 Claims, 10 Drawing Sheets

Related U.S. Application Data

(60) Provisional application No. 61/922,433, filed on Dec. 31, 2013, provisional application No. 61/617,643, filed on Mar. 29, 2012.

(51) Int. Cl.
*G10L 21/00* (2013.01)
*G10L 25/87* (2013.01)
*G10L 13/033* (2013.01)

(52) U.S. Cl.
CPC . *G10H 2210/061* (2013.01); *G10H 2240/141* (2013.01); *G10H 2250/235* (2013.01); *G10L 13/033* (2013.01); *G10L 25/87* (2013.01)

(58) Field of Classification Search
USPC ..... 704/270, 278; 84/610, 611, 634, 635
See application file for complete search history.

(56) References Cited

U.S. PATENT DOCUMENTS 8,682,653 B2 * 3/2014 Salazar ..... G10H 1/366 704/278
8,983,829 B2 * 3/2015 Cook ..... G10H 1/366 704/207
9,324,330 B2 * 4/2016 Chordia ..... G10L 19/00
9,459,768 B2 * 10/2016 Chordia ..... G10L 21/055
9,666,199 B2 * 5/2017 Chordia ..... G10L 21/055
9,866,731 B2 * 1/2018 Godfrey ..... G10H 1/366
9,911,403 B2 * 3/2018 Sung ..... G10H 1/366
2002/0169014 A1 * 11/2002 Egozy ..... G10H 1/0008 463/7
2005/0044272 A1 * 2/2005 Uzun ..... H04L 12/42 709/245
2006/0179142 A1 * 8/2006 Uzun ..... H04L 12/42 709/225
2007/0140510 A1 * 6/2007 Redmann ..... G10H 1/0058 84/645
2008/0201424 A1 * 8/2008 Darcie ..... H04N 7/15 709/204
2009/0164902 A1 * 6/2009 Cohen ..... G10H 1/0025 715/716
2009/0313016 A1 * 12/2009 Cevik ..... G10L 15/22 704/241
2010/0212478 A1 * 8/2010 Taub ..... G10H 1/0058 84/645
2010/0319518 A1 * 12/2010 Mehta ..... G10H 1/0058 84/625
2010/0326256 A1 * 12/2010 Emmerson ..... G10H 1/0025 84/610
2011/0251841 A1 10/2011 Cook et al.
2013/0144626 A1 * 6/2013 Shau ..... G10H 1/42 704/270
2013/0238444 A1 9/2013 Munaco et al.
2013/0339035 A1 12/2013 Chordia et al.
2017/0125057 A1 * 5/2017 Chordia ..... G10L 21/055
2017/0337927 A1 * 11/2017 Chordia ..... G10L 21/055
2018/0262654 A1 * 9/2018 Godfrey ..... G10H 1/366

OTHER PUBLICATIONS

M. Slaney et al.; "Automatic Audio Morphing", 1996 IEEE International Conference on Acoutics, Speech, and Signal Processing Conference Proceedings, vol. 2, Jan. 1, 1996, pp. 1001-1004.
Changsheng Xu, Namunu C. Maddage, and Xi Shao, "Automatic Music Classification and Summarization" IEEE Transactions on Speech and Audio Processing, 2005, vol. 13, No. 3., pp. 441-450.
Chao-Ling Hsu, Deliang Wang, and Jyh-Shing Roger Jang, "Trend Estitimation Algorithm for Singing Pitch Detection in Musical Recordings," In: Acoustics, Speech and Signal Processing, 2011 IEEE International Conference, Prague: IEEE, 2011, pp. 393-396.

* cited by examiner

COMPUTATIONALLY-ASSISTED MUSICAL SEQUENCING AND/OR COMPOSITION TECHNIQUES FOR SOCIAL MUSIC CHALLENGE OR COMPETITION

CROSS-REFERENCE TO RELATED APPLICATIONS

The present application claims priority of U.S. Provisional Application No. 61/922,433, filed Dec. 31, 2013. The present application is also a continuation-in-part of U.S. application Ser. No. 13/853,759, filed Mar. 29, 2013, which in turn claim priority of U.S. Provisional Application No. 61/617,643, filed Mar. 29, 2012, each of which is incorporated herein by reference.

BACKGROUND

Field of the Invention

The present invention relates generally to computational techniques including digital signal processing for music creation and, in particular, to techniques suitable for use in portable device hosted implementations of signal processing for vocal capture, musical composition and audio rendering of musical performances in furtherance of a social music challenge or competition.

Description of the Related Art

The installed base of mobile phones and other handheld compute devices grows in sheer number and computational power each day. Hyper-ubiquitous and deeply entrenched in the lifestyles of people around the world, they transcend nearly every cultural and economic barrier. Computationally, the mobile phones of today offer speed and storage capabilities comparable to desktop computers from less than ten years ago, rendering them surprisingly suitable for real-time sound synthesis and other digital signal processing based transformations of audiovisual signals.

Indeed, modern mobile phones and handheld computing devices, including iOS™ devices such as the iPhone™, iPod Touch™ and iPad™ digital devices available from Apple Inc. as well as competitive devices that run the Android operating system, all tend to support audio and video playback and processing quite capably. These capabilities (including processor, memory and I/O facilities suitable for real-time digital signal processing, hardware and software CODECs, audiovisual APIs, etc.) have contributed to vibrant application and developer ecosystems. Examples in the music application space include the popular I Am T-Pain, Glee Karaoke, social music apps available from SMule, Inc., which provide real-time continuous pitch correction of captured vocals, the Songify and AutoRap apps (also available from SMule), which adapt captured vocals to target music or meters and the LaDiDa reverse karaoke app (also available from SMule), which automatically composes music to accompany user vocals.

Engaging social interaction mechanisms, such as user-to-user challenge and/or competition, are desired for improved user experience, subscriber growth and existing subscriber retention.

SUMMARY

It has been discovered that, in an application that manipulates audio (or audiovisual) content, automated music creation technologies may be employed to generate new musical content using digital signal processing software hosted on handheld and/or server (or cloud-based) computing platforms to intelligently process and combine a set of audio content captured and submitted by users of modern mobile phones or other handheld computing platforms. The user-submitted recordings may contain speech, singing, musical instruments, or a wide variety of other sound sources, and the recordings may optionally be preprocessed by the handheld devices prior to submission.

In general, the combinations of audio content envisioned go well beyond a straightforward mixing of audio sources. For example, while the popular karaoke app, Sing! (introduced in 2012 and available from Smule, Inc.) includes a mode in which multiple users can join the same performance of a song, wherein output of such an ensemble performance includes an audio file in which the individual contributions have been summed together using the shared time base of the song's backing track, the combinations of audio content envisioned here include application of somewhat more sophisticated sequencing/composition algorithms to create a dynamic piece of music in which the structure of the output recording is governed largely by the content of the submitted recordings. In some cases or embodiments, additional captured content, such as that captured from a user performance on a synthetic musical instrument may be mixed with, and/or included with the content generated using music creation techniques described herein.

The present application focuses on an exemplary embodiment that, for purposes of illustration, employs AutoRap technology (described herein) as an illustrative music creation technology. Specifically, an exemplary AutoRap Battle interaction is described in which two users take turns submitting raw speech recordings to a server, and the server employs a battle-customized version of the AutoRap technology to render and update the ongoing battle performance after each new submission. However, based on the description herein, persons of skill in the art will appreciate a variety of variations and alternative embodiments, including embodiments in which music creation technologies are employed, alone or in combination.

A variety of music creation technologies may be employed in the audio processing pipeline of some embodiments of the present invention(s). For example, in some cases, vocal-type audio input is used to drive music creation technology of a type that has been popularized in the LaDiDa application for iOS and Android devices (available from SMule) to create custom soundtracks based on the audio portion of the coordinated audiovisual content. Captured or retrieved audio input (which typically though need not necessarily include vocals) is processed and music is automatically (i.e., algorithmically) composed to match or complement the input.

In general, LaDiDa-type processing operates by pitch tracking the input and finding an appropriate harmonization. A resulting chord map is then used to generate the music, with different instruments used depending on a selected style. Input audio (e.g., user vocals voiced or sung) is, in turn, pitch corrected to match the key of the auto-generated accompaniment. In some cases, particular instrument selections for the auto-generated accompaniment, key or other style aspects may be specified by the audio filter portion of the coordinated pairing. In some cases, results of structural analysis of the input audio performed in the course of audio pipeline processing, such as to identify verse and chorus boundaries, may be propagated to the video pipeline to allow coordinated video effects.

Another form of music creation technology that may be employed in the audio pipeline is audio processing of a type popularized in the Songify and AutoRap applications for iOS and Android devices (available from SMule). As before, captured or retrieved audio input (which typically includes vocals, though need not necessarily) are processed in the audio pipeline to create music. However, in the case of Songify and AutoRap technologies, the audio is adapted to an existing musical or rhythmic structure. In the case of Songify, audio input is segmented and remapped (as potentially reordered subphrases) to a phrase template of a target song. In the case of AutoRap, audio input is segmented, temporally aligned to a rhythmic skeleton of a target song.

In each case, music creation technology is employed together with captured vocal audio. A social interaction logic that presents users with a battle or competition framework for interactions and for sharing of resulting performances is also described. In some cases, rendering of the combined audio may be performed locally. In some cases, a remote platform separate from or integrated with a social networking service may perform the final rendering.

In some embodiments in accordance with the present invention, a social music method includes capturing, using an audio interface of a portable computing device, a raw vocal performance by a user of the portable computing device. The raw vocal performance is computationally segmented, segments of the segmented vocal performance are temporally remapped, and a derived musical composition is generated therefrom. The derived musical composition is audibly rendered at the portable computing device. The method further includes, responsive to a selection by the user, preparing a challenge and transmitting the challenge to a remote second user. The challenge includes, as a seed performance, the derived musical composition, together with the raw vocal performance captured.

In some embodiments in accordance with the present invention(s), a social music method includes capturing, using an audio interface of a portable computing device, a vocal performance by a user of the portable computing device. The method includes performing, in an audio processing pipeline, computationally segmenting the captured vocal performance, temporally remapping segments of the segmented vocal performance, and generating from the temporal remapping a derived musical composition. The method further includes audibly rendering the derived musical composition at the portable computing device and, responsive to a selection by the user, causing a challenge to be transmitted to a remote second user, the challenge including an encoding of the derived musical composition and a seed corresponding to the user's captured vocal performance.

In some cases or embodiments, the seed includes at least a portion of the user's captured vocal performance. In some cases or embodiments, the seed encodes the segmentation of the user's captured vocal performance.

In some embodiments the method further includes (i) receiving, for an vocal contribution of the remote second user captured in response to the challenge, a segmentation of the remote second user's vocal contribution; and (ii) from a combined segment set including at least some vocal segments captured from the user and at least some vocal segments captured from the remote second user, temporally remapping segments of the combined segment set and generating therefrom a derived musical composition including contributions of both the user and the remote second user.

In some embodiments the method further includes (i) receiving a vocal contribution of the remote second user captured in response to the challenge; and (ii) from a combined audio signal including at least some portions of the captured vocal performance of the user and at least some portions of the captured vocal contribution of the remote second user, (a) computationally segmenting the combined audio signal; (b) temporally remapping the segments of the combined audio signal; and (c) generating from the temporally remapped segments a derived musical composition including vocal content from both the user and the remote second user. The method further includes (iii) audibly rendering the derived musical composition at the portable computing device.

In some cases or embodiments, the audio processing pipeline is implemented on the portable computing device. In some cases or embodiments, the audio processing pipeline is implemented, at least in part, on a service platform in data communication with the portable computing device.

In some embodiments, the method is embodied as computer program product encoded in one or more media, the computer program product including instructions executable on a processor of the portable computing device to cause the portable computing device to perform or initiate the steps recited hereinabove. In some embodiments, the method is embodied as a system comprising the portable computing device programmed with instructions executable on a processor thereof to cause the portable computing device to perform or initiate the steps recited hereinabove.

In some embodiments of the present invention(s), a social music method includes receiving at a portable computing device, a challenge from a remote first user, the challenge including an encoding of musical composition derived from a vocal performance captured from the first user and a seed corresponding to the captured vocal performance; responsive to the challenge, capturing at the portable computing device a vocal contribution of a second user; and performing in an audio processing pipeline, (i) computationally segmenting at least the captured vocal contribution; (ii) temporally remapping segments from a combined segment set including at least some vocal segments captured from the remote first user and at least some vocal segments captured from the remote second user; and (iii) generating from the temporal remapping, a derived musical composition including contributions of both the remote first user and the second user. The method further includes audibly rendering the derived musical composition at the portable computing device.

In some embodiments, the method further includes responding to the challenge with an encoding of the derived musical composition and a next-level contribution corresponding to the captured vocal contribution of the second user. In some cases or embodiments, the received seed includes at least a portion of the vocal performance captured from the first user. In some cases or embodiments, the received seed encodes the segmentation of the vocal performance captured from the first user.

In some cases, the method is embodied as a computer program product encoded in one or more media, the computer program product including instructions executable on a processor of the portable computing device to cause the portable computing device to perform or initiate the steps recited hereinabove. In some cases, the method is embodied as a system comprising the portable computing device programmed with instructions executable on a processor thereof to cause the portable computing device to perform or initiate the steps recited hereinabove.

In some embodiments in accordance with the present invention(s), an audio processing pipeline includes a segmentation stage for computationally segmenting at least a current vocal contribution captured in connection with a vocal performance battle; a partition mapping stage for temporally remapping segments from a combined segment set including at least some vocal segments captured from an initial user's seed performance and at least some vocal segments from one or more subsequent vocal contributors, including the current vocal contribution, captured in connection with the vocal performance battle; and further stages for generating from the temporal remapping, a derived musical composition including contributions of the initial user and one or more of the subsequent vocal contributors and for rendering the derived musical composition as an audio signal. In some cases or embodiments, segmentations of a seed performance and of subsequent vocal contributions are introduced into the audio processing pipeline at, or before, the partition mapping stage for subsequent round audio processing.

These and other embodiments, together with numerous variations thereon, will be appreciated by persons of ordinary skill in the art based on the description, claims and drawings that follow.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 2:
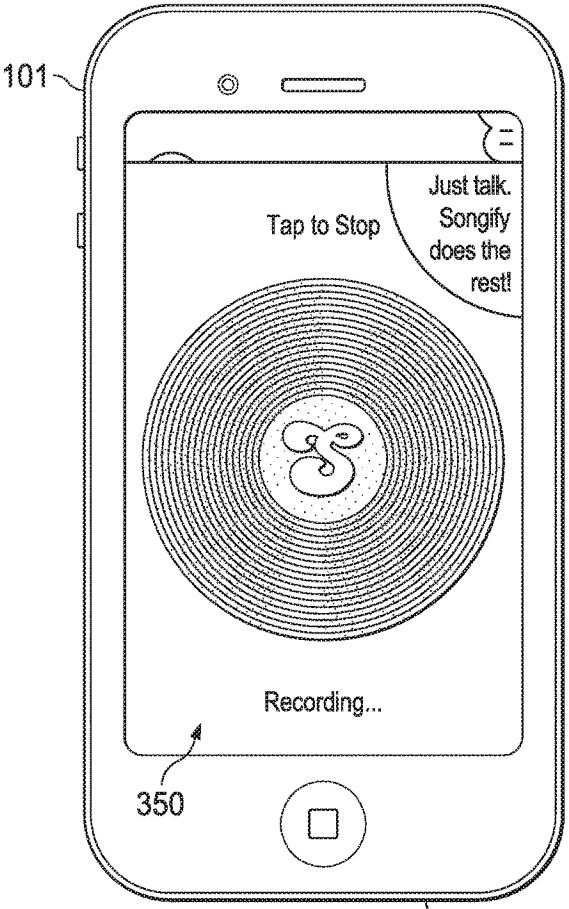
FIG. 2 is screen shot image of a programmed handheld computing platform (such as that depicted in FIG. 1) executing software to capture speech type vocals in preparation for automated transformation of a sampled audio signal in accordance with some embodiments of the present invention(s).

As described herein, automatic transformations of captured user vocals may provide captivating applications executable even on the handheld computing platforms that have become ubiquitous since the advent of iOS and Android-based phones, media devices and tablets. These transformations are presented to a subscribing user base, as well as to potential subscribers, in the context of a challenge or competition-type user interaction dynamic. Although detailed herein in the context of phone-, media-device and tablet-type devices, the envisioned automatic transformations and challenge/competition dynamic may even be implemented in purpose-built devices, such as for the toy, gaming or amusement device markets.

Issuing an AutoRap Battle Challenge

The social action of challenging another user is part of many implementations and operational modes of an AutoRap Battle. Prior to issuing one or more AutoRap Battle challenge invitations, a user makes several choices in a client-side app. These typically include selecting a song (e.g., from an in-app store, library or other collection), specifying whether the battle will be in talk mode or rap mode, choosing the number of musical bars in each submitted response, and enumerating or selecting a set of friends or contacts who will receive the invitation. In talk mode, users speak freely in time, using expression and pacing idiomatic to the language being spoken. The AutoRap technology segments that speech into phrases and remaps detected syllables onto a rhythmic template. In this mode, excerpts of the input recording are reshuffled in the final result. In rap mode, users follow and speak lyrics presented on-screen in real time or speak their own lyrics as the backing track plays in the background. The AutoRap technology in this mode makes more subtle corrections to timing and pitch of the voice (typically in later stages of an audio processing pipeline).

AutoRap audio processing pipelines operate to automatically transform speech captured from the various battle participants into audio signals that encode a derived musical composition in the genre of rap. In some embodiments, audio processing pipelines are provided on each of the handheld computing devices participating in a rap battle as well as on central servers. In this way, a user can preview his or her initial seed performance or the current multi-contributor battle output immediately (or closely) after completing vocal capture. The current, multi-contributor battle output can also be computed at a content server platform (potentially at somewhat higher fidelity and/or with additional optional processing) and shared with the opponent and with others after each new round of vocal capture.

In some cases or embodiments, once a user previews an initial AutoRap output on the handheld device and opts to issue challenge invitations, his/her raw speech capture is uploaded to a hosted content service platform. The service platform renders a musical composition (a seed performance) that forms the basis of the user's challenge to others. A notification or message to those challenged identifies a seed corresponding to the initial user's captured vocals (the seed performance). The seed (or seed performance) is used together with additional vocals captured (in a next or subsequent round of the rap battle) from those challenged to prepare a next- (or subsequent-) stage derived musical composition and to update rap battle state. In some cases or embodiments, the seed used in an AutoRap signal processing pipeline (at handheld and/or server) includes the captured raw vocal speech signal. In some cases or embodiments, the seed includes data derived from audio pipeline processing of the initial seed performance such as segmentation of the captured vocals after onset detections and peak picking (see audio pipeline detail, below).

Typically, a client-side AutoRap application sends messages referencing that seed performance to the selected contacts (or at least initiates a server-mediated process by which such messages or notifications are sent). In some cases or embodiments, a user can choose to send the challenge invitation to contacts who are already registered users of the application, e.g., via social networking communications native to an AutoRap service platform, via externally-supported social networks, via short message service (SMS) communications or via other suitable communication mechanism. Communications to facilitate successive stages of a rap battle (e.g., to communicate successive contributions in the form of vocal captures and/or segmentations thereof, etc.) are provided using like mechanisms.

Responding to a Challenge Invitation

Registered users of an AutoRap application who receive a challenge invitation will typically see the challenge appear on an in-app notifications area on their handheld device. Those receiving the challenge invitation via SMS or similar mechanisms may click on an embedded link to be directed to a challenge web page specific to the corresponding seed performance. In some cases or embodiments, that web page may display an option to open the challenge in the AutoRap application if the user already has already installed it, or to go to an app store and download the application. If the responding user elects to install the application, the service platform may record the IP address or other suitable identifier for the responder so that the challenge will be presented to the user when the AutoRap application is next opened by the responder.

Once an invitation recipient launches the application, he/she is able to preview the seed performance and opt to reply. If the recipient chooses to reply, the client-side app downloads or otherwise obtains information specifying the parameters for that battle (typically, user IDs of participants, identifier(s) for the underlying song and rhythmic skeleton to which captured vocals will be mapped, talk vs. rap mode, number of measures per battle round, links to raw vocal captures, etc.) and also downloads the seed (typically, the raw speech capture used to create the seed performance and/or segmentations or other data computationally-derived from the captured speech). In this way, the client-side application can quickly render the overall battle as soon as response vocals are captured, and can start playback to the next (here second) user while the audio renderer works ahead in real time. The client application need not wait for the server to finish rendering the entire battle performance before starting to play back the result to the second user.

When the second user (or more-generally, a next-stage user) is satisfied with his/her response, the captured response vocals are communicated to other battle participants (typically with data analogous to that that constituted the initial seed) via the server, which updates a rap battle object (or data structure) that maintains the evolving state of the battle—the user IDs of the participants, whose turn it is, the underlying song or backing track, a current mode (e.g., talk or rap mode), a number of measures per battle round, links or identifiers for stored raw vocals, seeds, subsequent vocal contributions and/or derived data, and shareable links to the successive round musical compositions rendered by applying the AutoRap audio pipeline to battle states.

Successive Battle Rounds

Battle participants continue to take turns responding to one another with additional vocal captures until a maximum number of rounds have been completed or until one or more participants are satisfied with the battle state. Note that in some cases or embodiments, battle rounds may alternate between a pair of participants, while in other cases or embodiments (and in particular for larger numbers of participants) participants may battle in accord with first-come-first-served, round-robin or some other suitable sequencing. In some cases or embodiments, the number of total rounds may be limited to a small number, e.g., to three rounds between a battling pair. Typically participants take turns contributing vocals and the AutoRap sequencer and renderer computationally derives (at each battle round) a musical composition that selects from and integrates vocal content captured initially and at each battle round. As with the initial seed, successive vocal contributions may include the captured vocals themselves together with data derived from an AutoRap audio pipeline processing, such as segmentation of the captured vocals after onset detections and peak picking (again, see audio pipeline detail, below).

In some cases or embodiments, newly captured raw vocal contributions are introduced, together with captured vocals of the seed and of contributions in earlier rounds of the battle, into the AutoRap pipeline as a concatenated or composite audio signal. AutoRap audio pipeline processing, such as segmentation of the captured vocals after onset detections and peak picking, subphrase partitioning, mapping to phrase templates, rhythmic alignments, etc. are performed on the concatenated or composite audio signal to produce the derived musical composition for the current battle round. In some cases or embodiments, results of earlier round processing, e.g., captured vocal segmentations from earlier rounds of the battle are introduced into subsequent stages of the AutoRap pipeline. Fairness logic may be employed to ensure a desired level of balance amongst vocal contributions and/or to ensure that at least some segments from an initial seed performance are included in the derived musical composition at each stage of the battle. In some cases or embodiments, a distinctive or interesting "hook" may be maintained throughout a succession of derived musical compositions. In some case, the hook may be predetermined, e.g., based the initial seed or underlying song/template to which contributions are mapped, while in others, the hook may be computationally determined based on figures of merit calculated for segments of the seed performance or a successive vocal contribution.

When a user submits a response, their opponent receives an in-app notification. In some cases or embodiments support for third parties to "watch" the battle and receive notifications may be provided. In addition, in some cases or embodiments support may be provided for members of the app/web community to comment on each new submission, and (optionally) include a voting mechanism allowing third parties to vote on who won each round or the battle as a whole.

Music Creation Generally

Advanced digital signal processing techniques described herein allow implementations in which mere novice user-musicians may generate, audibly render and share musical performances. In some cases, the automated transformations allow spoken vocals to be segmented, arranged, temporally aligned with a target rhythm, meter or accompanying backing tracks and pitch corrected in accord with a score or note sequence. Speech-to-song music implementations are one such example and exemplary songification application is described below. In some cases, spoken vocals may be transformed in accord with musical genres such as rap using automated segmentation and temporal alignment techniques, often without pitch correction. Such applications, which may employ different signal processing and different automated transformations, may nonetheless be understood as speech-to-rap variations on the theme. Adaptations to provide an exemplary AutoRap application are also described herein.

In the interest of concreteness, processing and device capabilities, terminology, API frameworks and even form factors typical of a particular implementation environment, namely the iOS device space popularized by Apple, Inc. have been assumed. Notwithstanding descriptive reliance on any such examples or framework, persons of ordinary skill in the art having access to the present disclosure will appreciate deployments and suitable adaptations for other computing platforms and other concrete physical implementations.

Automated Speech to Music Transformation

Figure 1:
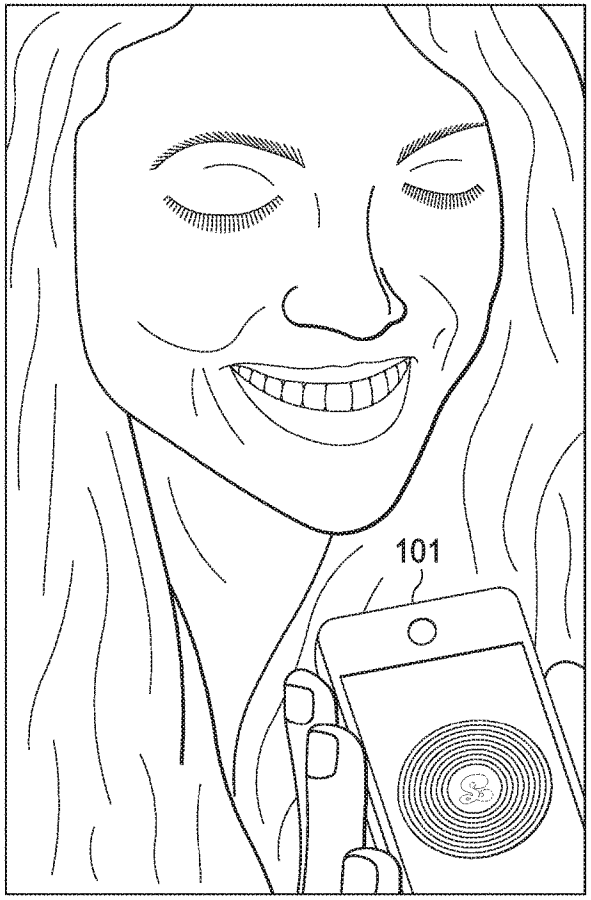
FIG. 1 is a visual depiction of a user speaking proximate to a microphone input of an illustrative handheld computing platform that has been programmed in accordance with some embodiments of the present invention(s) to automatically transform a sampled audio signal into song, rap or other expressive genre having meter or rhythm for audible rendering.

FIG. 1 is depiction of user speaking proximate to a microphone input of an illustrative handheld computing platform 101 that has been programmed in accordance with some embodiments of the present invention(s) to automatically transform a sampled audio signal into song, rap or other expressive genre having meter or rhythm for audible rendering. FIG. 2 is an illustrative capture screen image of programmed handheld computing platform 101 executing application software (e.g., application 350) to capture speech type vocals (e.g., from microphone input 314) in preparation for automated transformation of a sampled audio signal.

Figure 3:
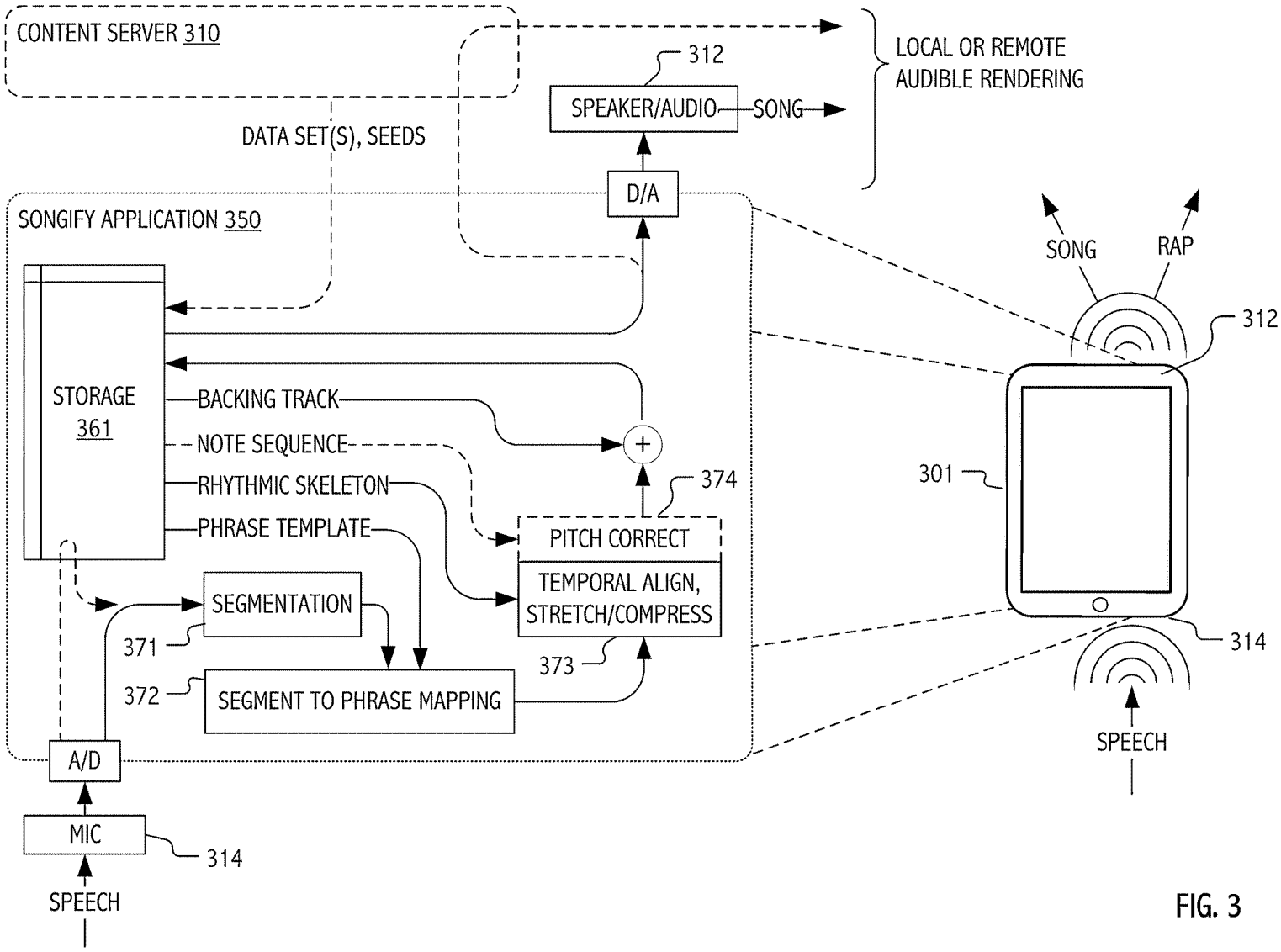
FIG. 3 is a functional block diagram illustrating data flows amongst functional blocks of in, or in connection with, an illustrative handheld computing platform embodiment of the present invention(s).

FIG. 3 is a functional block diagram illustrating data flows amongst functional blocks of, or in connection with, an illustrative iOS-type handheld 301 computing platform embodiment of the present invention(s) in which application 350 executes to automatically transform vocals captured using a microphone 314 (or similar interface) and is audibly rendered (e.g., via speaker 312 or coupled headphone). Data sets for particular musical targets (e.g., a backing track, phrase template, pre-computed rhythmic skeleton, optional score and/or note sequences) may be downloaded into local storage 361 (e.g., demand supplied or as part of a software distribution or update) from a remote content server 310 or other service platform.

Figure 4:
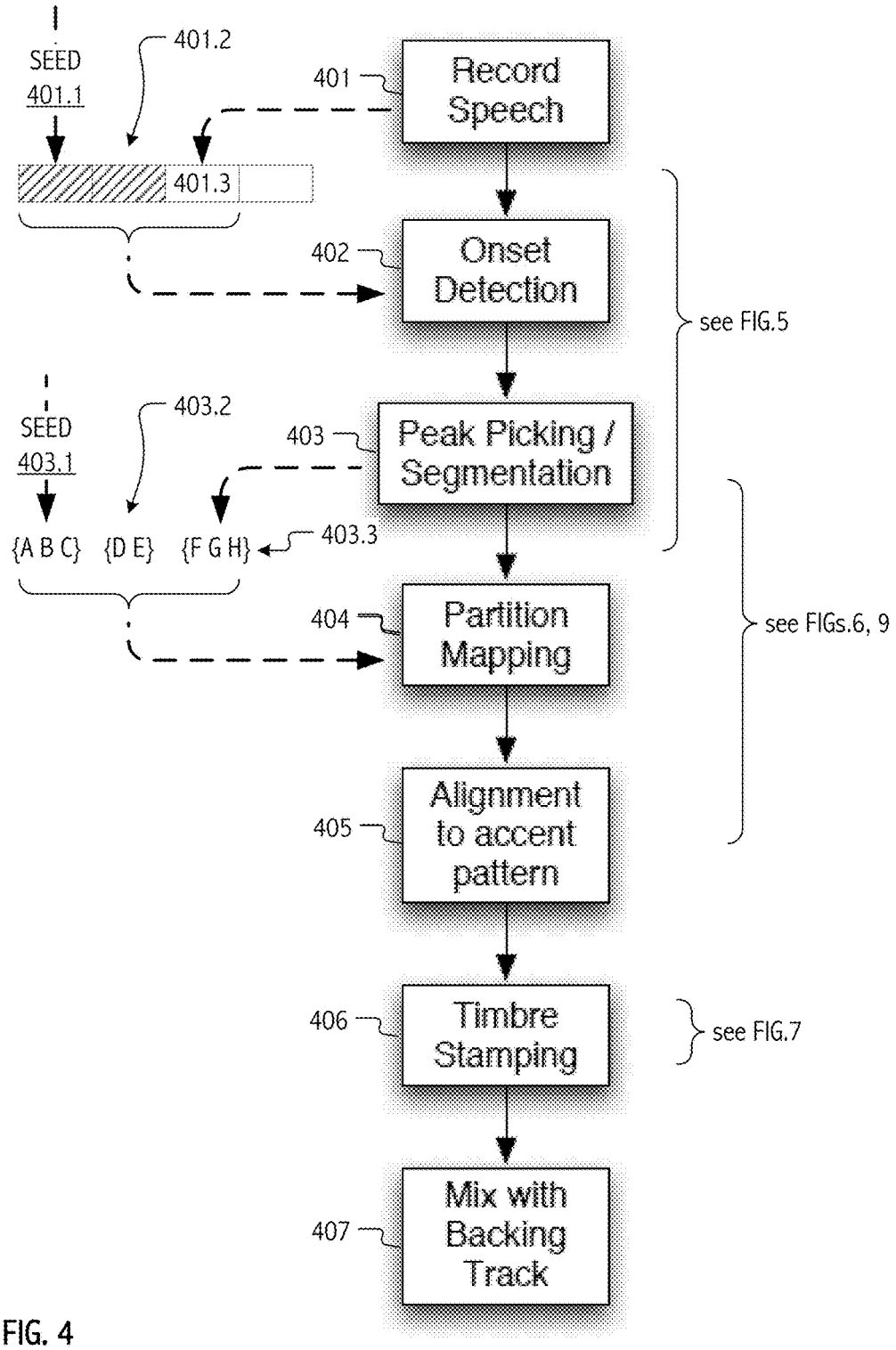
FIG. 4 is a flowchart illustrating a sequence of steps in an illustrative method whereby, in accordance with some embodiments of the present invention(s), a captured speech audio encoding is automatically transformed into an output song, rap or other expressive genre having meter or rhythm for audible rendering with a backing track.

Various illustrated functional blocks (e.g., audio signal segmentation 371, segment to phrase mapping 372, temporal alignment and stretch/compression 373 of segments, and pitch correction 374) will be understood, with reference to signal processing techniques detailed herein, to operate upon audio signal encodings derived from captured vocals and represented in memory or non-volatile storage on the computing platform. FIG. 4 is a flowchart illustrating a sequence of steps (401, 402, 403, 404, 405, 406 and 407) in an illustrative method whereby a captured speech audio encoding (e.g., that captured from microphone 314, recall FIG. 3), is automatically transformed into an output song, rap or other expressive genre having meter or rhythm for audible rendering with a backing track. Specifically, FIG. 4 summarizes an audio pipeline flow (e.g., through functional or computational blocks such as illustrated relative to application 350 executing on the illustrative iOS-type handheld 301 compute platform, recall FIG. 3) that includes:

- capture or recording (401) of speech as an audio signal;
- detection (402) of onsets or onset candidates in the captured audio signal;
- picking from amongst the onsets or onset candidates peaks or other maxima so as to generate segmentation (403) boundaries that delimit audio signal segments;
- mapping (404) individual segments or groups of segments to ordered sub-phrases of a phrase template or other skeletal structure of a target song (e.g., as candidate phrases determined as part of a partitioning computation);
- evaluating rhythmic alignment (405) of candidate phrases to a rhythmic skeleton or other accent pattern/structure for the target song and (as appropriate) stretching/compressing to align voice onsets with note onsets and (in some cases) to fill note durations based on a melody score of the target song;
- using a vocoder or other filter re-synthesis-type timbre stamping (406) technique by which captured vocals (now phrase-mapped and rhythmically aligned) are shaped by features (e.g., rhythm, meter, repeat/reprise organization) of the target song; and
- eventually mixing (407) the resultant temporally aligned, phrase-mapped and timbre stamped audio signal with a backing track for the target song.

These and other aspects are described in greater detail below and illustrated relative to FIGS. 5-8.

As described above and referring to FIG. 4, audio pipeline processing such as performed in an AutoRap audio pipeline may be applied at an initial seed stage as well as for vocal contributions captured (or recorded) in subsequent rounds of a rap battle. Typically, in audio pipeline processing for subsequent rounds, a seed and results from earlier rounds are introduced into the pipeline. For example, in a second battle round, an initial seed 401.1 (e.g., captured raw vocals of the seed performance) together with captured raw vocals 401.2 from a first-round contribution and captured raw vocals 401.3 from the (current) second-round user may be combined in an audio signal supplied into onset detection 402 stage of an AutoRap audio pipeline. In this way, vocal contributions from the initial seed performance and from subsequent battle rounds are included in the audio content processed through subsequent pipeline stages 403, 404, 405, 406 and 407.

Alternatively, segmentation (after onset detection 402 and peak picking) of the captured raw vocals of a second round contribution (e.g., segmentation into subphrases {F G H}) may be accreted with segmentations 403.1 and 403.2 performed in earlier rounds for captured raw vocals of the seed performance (e.g., segmentation into subphrases {A B C}) and for captured raw vocals of the first-round contribution (e.g., segmentation into subphrases {D E}). Accreted results of these segmentations may be carried forward (together with corresponding audio signals) in data supplied into partition mapping 404 stage of an AutoRap audio pipeline. In this way, vocal contributions and segmentations from the initial seed performance and subsequent battle rounds are included in the audio content processed through subsequent pipeline stages 405, 406 and 407.

Speech Segmentation

When lyrics are set to a melody, it is often the case that certain phrases are repeated to reinforce musical structure. Our speech segmentation algorithm attempts to determine boundaries between words and phrases in the speech input so that phrases can be repeated or otherwise rearranged. Because words are typically not separated by silence, simple silence detection may, as a practical matter, be insufficient in many applications. Exemplary techniques for segmentation of the captured speech audio signal will be understood with reference to FIG. 5 and the description that follows.

Sone Representation

The speech utterance is typically digitized as speech encoding 501 using a sample rate of 44100 Hz. A power spectrum is computed from the spectrogram. For each frame, an FFT is taken using a Hann window of size 1024 (with a 50% overlap). This returns a matrix, with rows representing frequency bins and columns representing time-steps. In order to take into account human loudness perception, the power spectrum is transformed into a sone-based representation. In some implementations, an initial step of this process involves a set of critical-band filters, or bark band filters 511, which model the auditory filters present in the inner ear. The filter width and response varies with frequency, transforming the linear frequency scale to a logarithmic one. Additionally, the resulting sone representation 502 takes into account the filtering qualities of the outer ear as well as modeling spectral masking. At the end of this process, a new matrix is returned with rows corresponding to critical bands and columns to time-steps.

Onset Detection

One approach to segmentation involves finding onsets. New events, such as the striking of a note on a piano, lead to sudden increases in energy in various frequency bands. This can often be seen in the time-domain representation of the waveform as a local peak. A class of techniques for finding onsets involves computing (512) a spectral difference function (SDF). Given a spectrogram, the SDF is the first difference and is computed by summing the differences in amplitudes for each frequency bin at adjacent time-steps. For example:

$$\mathrm{SDF}[i]=(\Sigma(B[i]-B[i-1])^{0.25})^4$$

Figure 5:
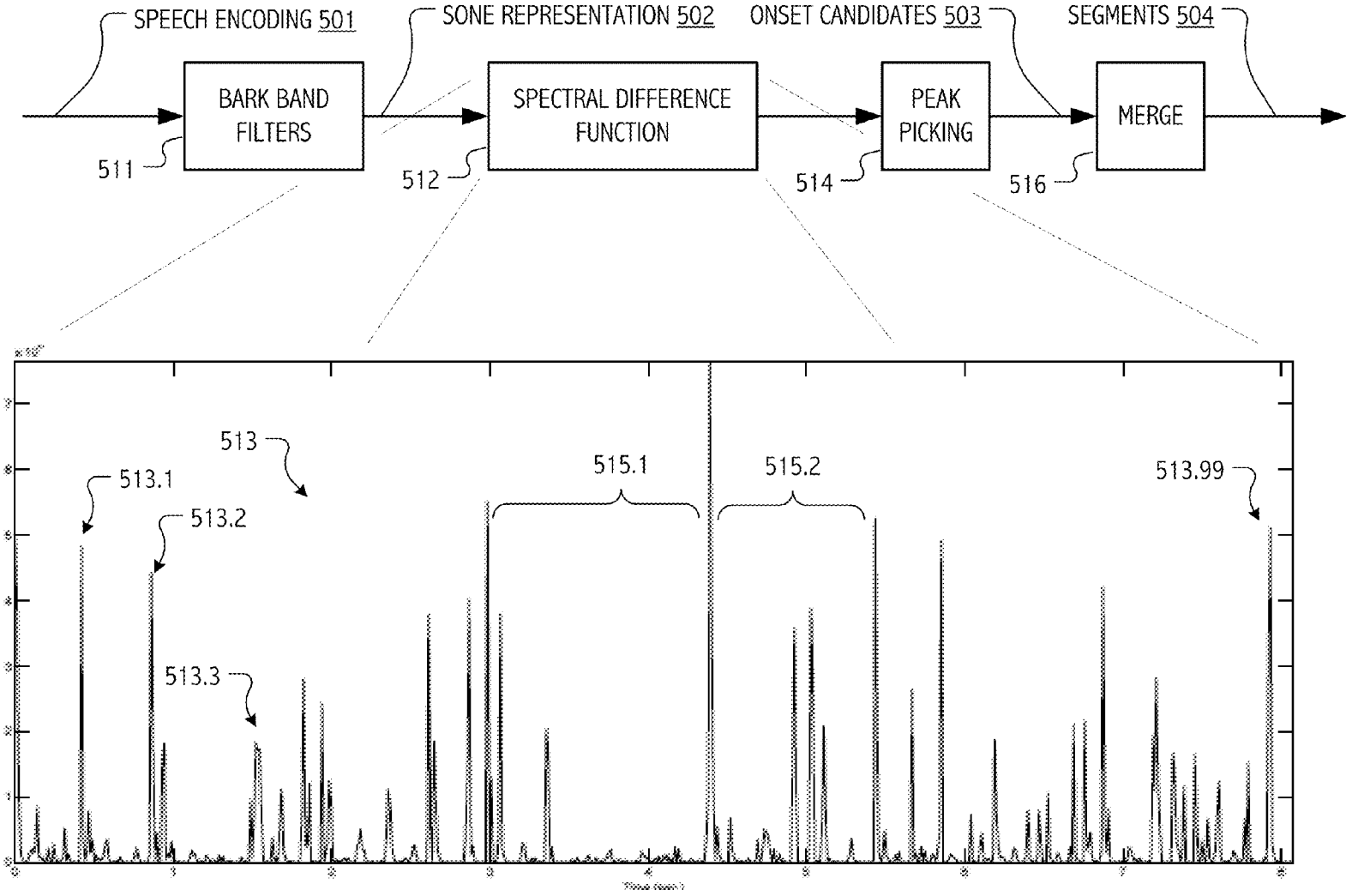
FIG. 5 illustrates, by way of a flowchart and a graphical illustration of peaks in a signal resulting from application of a spectral difference function, a sequence of steps in an illustrative method whereby an audio signal is segmented in accordance with some embodiments of the present invention(s).

Here we apply a similar procedure to the sone representation, yielding a type of SDF 513. The illustrated SDF 513 is a one-dimensional function, with peaks indicating likely onset candidates. FIG. 5 depicts an exemplary SDF computation 512 from an audio signal encoding derived from sampled vocals together with signal processing steps that precede and follow SDF computation 512 in an exemplary audio processing pipeline.

We next define onset candidates 503 to be the temporal location of local maxima (or peaks 513.1, 513.2, 513.3 . . . 513.99) that may be picked from the SDF (513). These locations indicate the possible times of the onsets. We additionally return a measure of onset strength that is determined by subtracting the level of the SDF curve at the local maximum from the median of the function over a small window centered at the maximum. Onsets that have an onset strength below a threshold value are typically discarded. Peak picking 514 produces a series of above-threshold-strength onset candidates 503.

We define a segment (e.g., segment 515.1) to be a chunk of audio between two adjacent onsets. In some cases, the onset detection algorithm described above can lead to many false positives leading to very small segments (e.g. much smaller than the duration of a typical word). To reduce the number of such segments, certain segments (see e.g., segment 515.2) are merged (515.2)) using an agglomeration algorithm. First, we determine whether there are segments that are shorter than a threshold value (here we start at 0.372 seconds threshold). If so, they are merged with a segment that temporally precedes or follows. In some cases, the direction of the merge is determined based on the strength of the neighboring onsets.

The result is segments that are based on strong onset candidates and agglomeration of short neighboring segments to produce the segments (504) that define a segmented version of the speech encoding (501) that are used in subsequent steps. In the case of speech-to-song embodiments (see FIG. 6), subsequent steps may include segment mapping to construct phrase candidates and rhythmic alignment of phrase candidates to a pattern or rhythmic skeleton for a target song. In the case of speech-to-rap embodiments (see FIG. 9), subsequent steps may include alignment of segment delimiting onsets to a grid or rhythmic skeleton for a target song and stretching/compressing of particular aligned segments to fill to corresponding portions of the grid or rhythmic skeleton.

Phrase Construction for Speech-to-Song Embodiments

Figure 6:
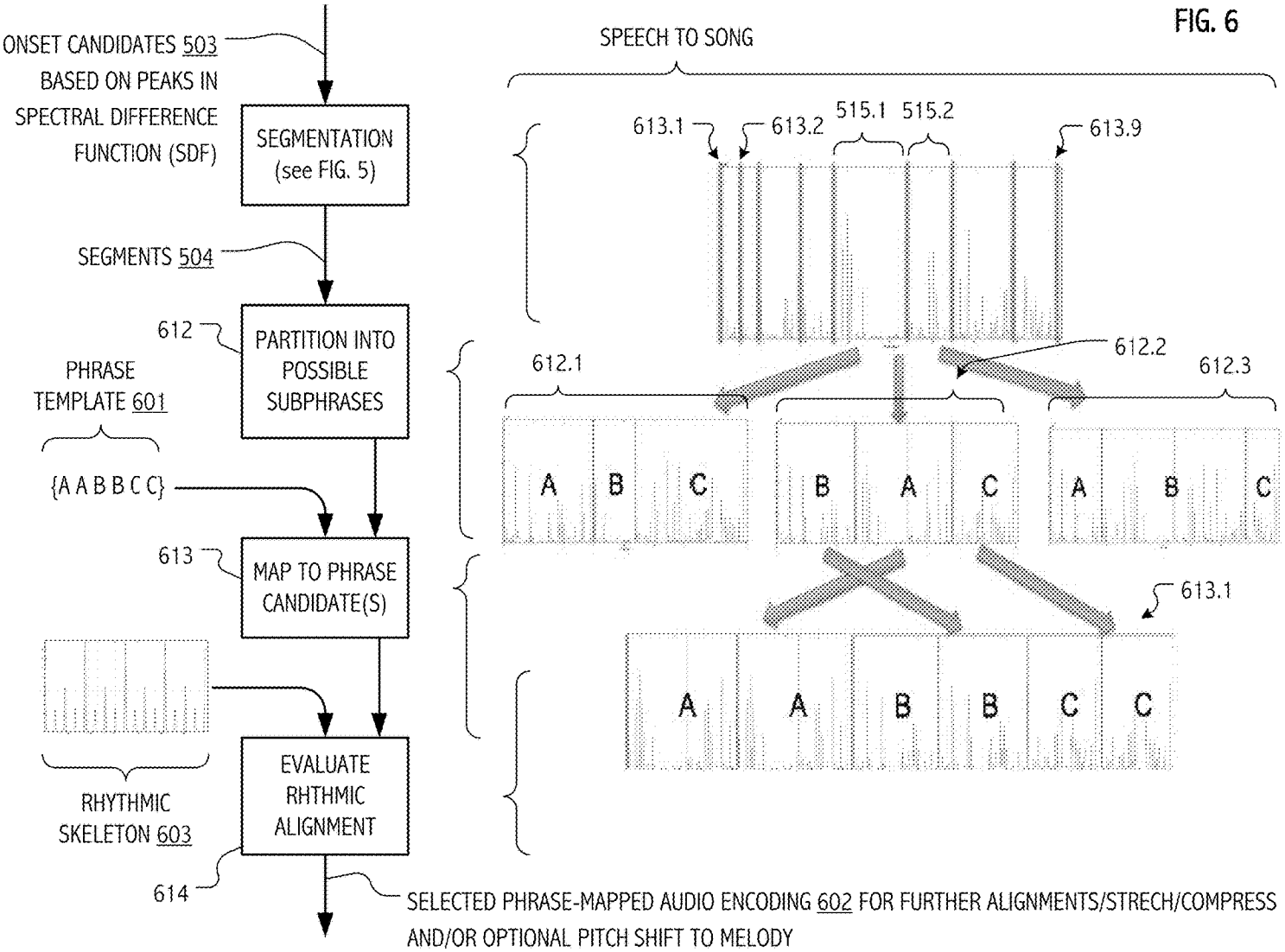
FIG. 6 illustrates, by way of a flowchart and a graphical illustration of partitions and sub-phrase mappings to a template, a sequence of steps in an illustrative method whereby a segmented audio signal is mapped to a phrase template and resulting phrase candidates are evaluated for rhythmic alignment therewith in accordance with some speech-to-song targeted embodiments of the present invention(s).

FIG. 6 illustrates, in further detail, phrase construction aspects of a larger computational flow (e.g., as summarized in FIG. 4 through functional or computational blocks such as previously illustrated and described relative to an application executing on a computing platform, recall FIG. 3). The illustration of FIG. 6 pertains to certain illustrative speech-to-song embodiments.

One goal of previously described the phrase construction step is to create phrases by combining segments (e.g., segments 504 such as may be generated in accord with techniques illustrated and described above relative to FIG. 5), possibly with repetitions, to form larger phrases. The process is guided by what we term phrase templates. A phrase template encodes a symbology that indicates the phrase structure, and follows a typical method for representing musical structure. For example, the phrase template {A A B B C C} indicates that the overall phrase consists of three sub-phrases, with each sub-phrase repeated twice. The goal of phrase construction algorithms described herein is to map segments to sub-phrases. After computing (612) one or more candidate sub-phrase partitionings of the captured speech audio signal based on onset candidates 503 and segments 504, possible sub-phrase partionings (e.g., partionings 612.1, 612.2 . . . 612.3) are mapped (613) to structure of phrase template 601 for the target song. Based on the mapping of sub-phrases (or indeed candidate sub-phrases) to a particular phrase template, a phrase candidate 613.1 is produced. FIG. 6 illustrates this process diagrammatically and in connection with subsequence of an illustrative process flow. In general, multiple phrase candidates may be prepared and evaluated to select a particular phrase-mapped audio encoding for further processing. In some embodiments, the quality of the resulting phrase mapping (or mappings) is (are) evaluated (614) based on the degree of rhythmic alignment with the underlying meter of the song (or other rhythmic target), as detailed elsewhere herein.

In some implementations of the techniques, it is useful to require the number of segments to be greater than the number of sub-phrases. Mapping of segments to sub-phrases can be framed as a partitioning problem. Let m be the number of sub-phrases in the target phrase. Then we require m−1 dividers in order to divide the vocal utterance into the correct number of phrases. In our process, we allow partitions only at onset locations. For example, in FIG. 6, we show a vocal utterance with detected onsets (613.1, 613.2 . . . 613.9) and evaluated in connection with target phrase structure encoded by phrase template 601 {A A B B C C}. Adjacent onsets are combined, as shown in FIG. 6, in order to generate the three sub-phrases A, B, and C. The set of all possible partitions with m parts and n onsets is $\binom{n}{m-1}$ One of the computed partitions, namely sub-phrase partitioning 613.2, forms the basis of a particular phrase candidate 613.1 selected based on phrase template 601.

Note that some embodiments, a user may select and reselect from a library of phrase templates for differing target songs, performances, artists, styles etc. In some embodiments, phrase templates may be transacted, made available or demand supplied (or computed) in accordance with a part of an in-app-purchase revenue model or may be earned, published or exchanged as part of a gaming, teaching and/or social-type user interaction supported.

Because the number of possible phrases increases combinatorially with the number of segments, in some practical implementations, we restrict the total segments to a maximum of 20. Of course, more generally and for any given application, search space may be increased or decreased in accord with processing resources and storage available. If the number of segments is greater than this maximum after the first pass of the onset detection algorithm, the process is repeated using a higher minimum duration for agglomerating the segments. For example, if the original minimum segment length was 0.372 seconds, this might be increased to 0.5 seconds, leading to fewer segments. The process of increasing the minimum threshold will continue until the number of target segments is less than the desired amount. On the other hand, if the number of segments is less than the number of sub-phrases, then it will generally not be possible to map segments to sub-phrases without mapping the same segment to more than one sub-phrase. To remedy this, the onset detection algorithm is reevaluated in some embodiments using a lower segment length threshold, which typically results in fewer onsets agglomerated into a larger number of segments. Accordingly, in some embodiments, we continue to reduce the length threshold value until the number of segments exceeds the maximum number of sub-phrases present in any of the phrase templates. We have a minimum sub-phrase length we have to meet, and this is lowered if necessary to allow partitions with shorter segments.

Based on the description herein, persons of ordinary skill in the art will recognize numerous opportunities for feeding back information from later stages of a computational process to earlier stages. Descriptive focus herein on the forward direction of process flows is for ease and continuity of description and is not intended to be limiting.

Rhythmic Alignment

Each possible partition described above represents a candidate phrase for the currently considered phrase template. To summarize, we exclusively map one or more segments to a sub-phrase. The total phrase is then created by assembling the sub-phrases according to the phrase template. In the next stage, we wish to find the candidate phrase that can be most closely aligned to the rhythmic structure of the backing track. By this we mean we would like the phrase to sound as if it is on the beat. This can often be achieved by making sure accents in the speech tend to align with beats, or other metrically important positions.

To provide this rhythmic alignment, we introduce a rhythmic skeleton (RS) 603 as illustrated in FIG. 6, which gives the underlying accent pattern for a particular backing track. In some cases or embodiments, rhythmic skeleton 603 can include a set of unit impulses at the locations of the beats in the backing track. In general, such a rhythmic skeleton may be precomputed and downloaded for, or in conjunction with, a given backing track or computed on demand. If the tempo is known, it is generally straightforward to construct such an impulse train. However, in some tracks it may be desirable to add additional rhythmic information, such as the fact that the first and third beats of a measure are more accented than the second and fourth beats. This can be done by scaling the impulses so that their height represents the relative strength of each beat. In general, an arbitrarily complex rhythmic skeleton can be used. The impulse train, which consists of a series of equally spaced delta functions is then convolved with a small Hann (e.g. five-point) window to generate a continuous curve:

$$RS[n] = \sum_{m=0}^{N-1} \omega[n] * \delta[n-m],$$

where $$\omega(n) = 0.5\left(1 - \cos\frac{2\pi n}{N-1}\right)$$

We measure the degree of rhythmic alignment (RA), between the rhythmic skeleton and the phrase, by taking the cross correlation of the RS with the spectral difference function (SDF), calculated using the sone representation. Recall that the SDF represents sudden changes in signal that correspond to onsets. In the music information retrieval literature we refer to this continuous curve that underlies onset detection algorithms as a detection function. The detection function is an effective method for representing the accent or mid-level event structure of the audio signal. The cross correlation function measures the degree of correspondence for various lags, by performing a point-wise multiplication between the RS and the SDF and summing, assuming different starting positions within the SDF buffer. Thus for each lag the cross correlation returns a score. The peak of the cross correlation function indicates the lag with the greatest alignment. The height of the peak is taken as a score of this fit, and its location gives the lag in seconds.

The alignment score A is then given by $$\max A[n] = \max \sum_{m=0}^{N-1} RS[n-m] * SDF[m]$$

This process is repeated for all phrases and the phrase with the highest score is used. The lag is used to rotate the phrase so that it starts from that point. This is done in a circular manner. It is worth noting that the best fit can be found across phrases generated by all phrase templates or just a given phrase template. We choose to optimize across all phrase templates, giving a better rhythmic fit and naturally introducing variety to the phrase structure.

When a partition mapping requires a sub-phrase to repeat (as in a rhythmic pattern such as specified by the phrase template {A A B C}), the repeated sub-phrase was found to sound more rhythmic when the repetition was padded to occur on the next beat. Likewise, the entire resultant partitioned phrase is padded to the length of a measure before repeating with the backing track.

Accordingly, at the end of the phrase construction (613) and rhythmic alignment (614) procedure, we have a complete phrase constructed from segments of the original vocal utterance that has been aligned to the backing track. If the backing track or vocal input is changed, the process is re-run. This concludes the first part of an illustrative "songification" process. A second part, which we now describe, transforms the speech into a melody.

To further synchronize the onsets of the voice with the onsets of the notes in the desired melody line, we use a procedure to stretch voice segments to match the length of the melody. For each note in the melody, the segment onset (calculated by our segmentation procedure described above) that occurs nearest in time to the note onset while still within a given time window is mapped to this note onset. The notes are iterated through (typically exhaustively and typically in a generally random order to remove bias and to introduce variability in the stretching from run to run) until all notes with a possible matching segment are mapped. The note-to-segment map then is given to the sequencer which then stretches each segment the appropriate amount such that it fills the note to which it is mapped. Since each segment is mapped to a note that is nearby, the cumulative stretch factor over the entire utterance should be more or less unity, however if a global stretch amount is desired (e.g. slow down the result utterance by 2), this is achieved by mapping the segments to a sped-up version of the melody: the output stretch amounts are then scaled to match the original speed of the melody, resulting in an overall tendency to stretch by the inverse of the speed factor.

Although the alignment and note-to-segment stretching processes synchronize the onsets of the voice with the notes of the melody, the musical structure of the backing track can be further emphasized by stretching the syllables to fill the length of the notes. To achieve this without losing intelligibility, we use dynamic time stretching to stretch the vowel sounds in the speech, while leaving the consonants as they are. Since consonant sounds are usually characterized by their high frequency content, we used spectral roll-off up to 95% of the total energy as the distinguishing feature between vowels and consonants. Spectral roll-off is defined as follows. If we let |X[k]| be the magnitude of the k-th Fourier coefficient, then the roll-off for a threshold of 95% is defined to be $k_roll = \Sigma_{k=0}^{k_roll} X[k] < 0.95 * \Sigma_{k=0}^{N-1} |X[k]|$, where N is the length of the FFT. In general, a greater k_roll Fourier bin index is consistent with increased high-frequency energy and is an indication of noise or an unvoiced consonant. Likewise, a lower k_roll Fourier bin index tends to indicate a voiced sound (e.g., a vowel) suitable for time stretching or compression.

The spectral roll-off of the voice segments are calculated for each analysis frame of 1024 samples and 50% overlap. Along with this the melodic density of the associated melody (MIDI symbols) is calculated over a moving window, normalized across the entire melody and then interpolated to give a smooth curve. The dot product of the spectral roll-off and the normalized melodic density provides a matrix, which is then treated as the input to the standard dynamic programming problem of finding the path through the matrix with the minimum associated cost. Each step in the matrix is associated with a corresponding cost that can be tweaked to adjust the path taken through the matrix. This procedure yields the amount of stretching required for each frame in the segment to fill the corresponding notes in the melody.

Speech to Melody Transform

Although fundamental frequency, or pitch, of speech varies continuously, it is does not generally sound like a musical melody. The variations are typically too small, too rapid, or too infrequent to sound like a musical melody. Pitch variations occur for a variety of reasons including the mechanics of voice production, the emotional state of the speaker, to indicate phrase endings or questions, and an inherent part of tone languages.

In some embodiments, the audio encoding of speech segments (aligned/stretched/compressed to a rhythmic skeleton or grid as described above) is pitch corrected in accord with a note sequence or melody score. As before, the note sequence or melody score may be precomputed and downloaded for, or in connection with, a backing track.

Figure 7:
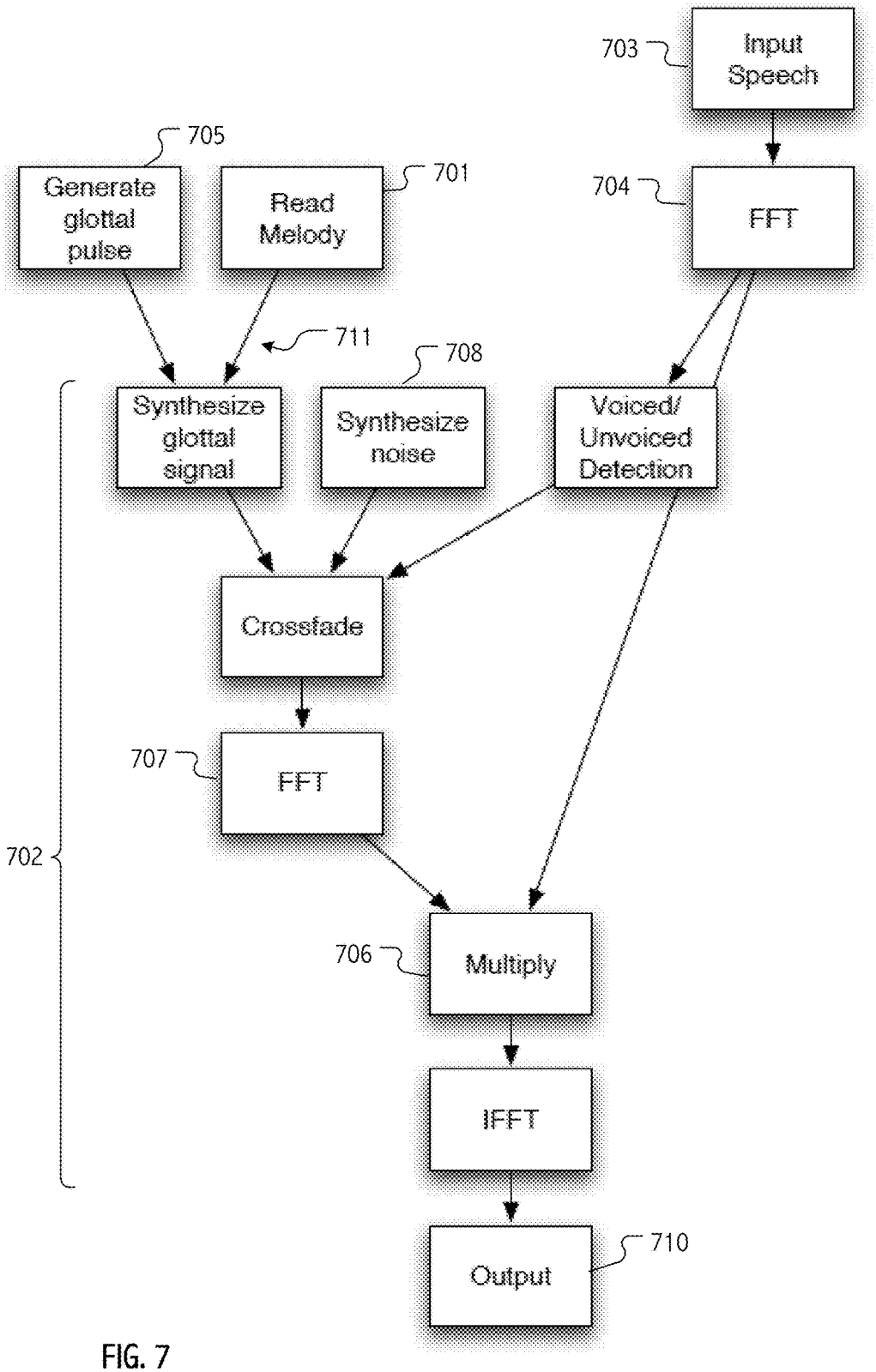
FIG. 7 graphically illustrates signal processing functional flows in a speech-to-song (songification) application in accordance with some embodiments of the present invention.

For some embodiments, a desirable attribute of an implemented speech-to-melody (S2M) transformation is that the speech should remain intelligible while sounding clearly like a musical melody. Although persons of ordinary skill in the art will appreciate a variety of possible techniques that may be employed, our approach is based on cross-synthesis of a glottal pulse, which emulates the periodic excitation of the voice, with the speaker's voice. This leads to a clearly pitched signal that retains the timbral characteristics of the voice, allowing the speech content to be clearly understood in a wide variety of situations. FIG. 7 shows a block diagram of signal processing flows in some embodiments in which a melody score 701 (e.g., that read from local storage, downloaded or demand-supplied for, or in connection with, a backing track, etc.) is used as an input to cross synthesis (702) of a glottal pulse. Source excitation of the cross synthesis is the glottal signal (from 705), while target spectrum is provided by FFT 704 of the input vocals.

Figure 8:
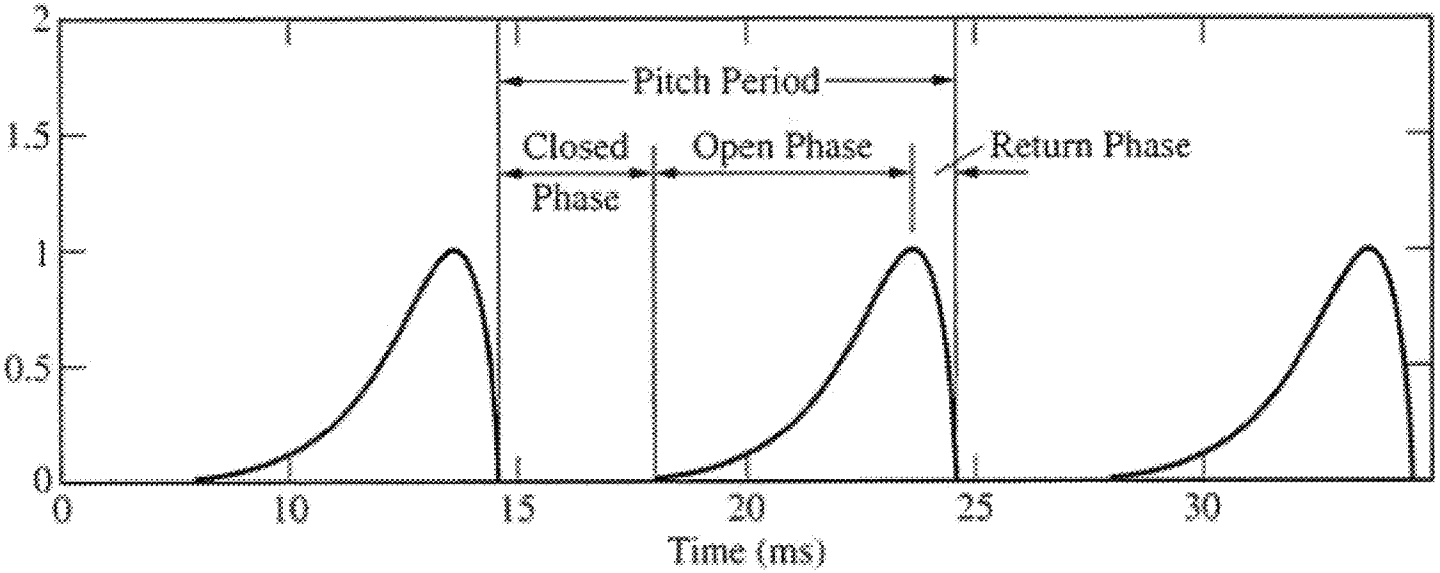
FIG. 8 graphically illustrates a glottal pulse model that may be employed in some embodiments in accordance with the present invention for synthesis of a pitch shifted version of an audio signal that has been aligned, stretched and/or compressed in correspondence with a rhythmic skeleton or grid.

The input speech 703 is sampled at 44.1 kHz and its spectrogram is calculated (704) using a 1024 sample Hann window (23 ms) overlapped by 75 samples. The glottal pulse (705) was based on the Rosenberg model which is shown in FIG. 8. It is created according to the following equation and consists of three regions that correspond to pre-onset ($0-t_0$), onset-to-peak ($t_0-t_f$), and peak-to-end ($t_f-T_p$). $T_p$ is the pitch period of the pulse. This is summarized by the following equation:

$$g(t) = \begin{cases} 0 \text{ for } 0 \le t \le t_0 \\ A_g \sin\left(\frac{\pi}{2} \frac{t - t_0}{t_f - t_0}\right) \\ A_g \sin\left(\frac{\pi}{2} \frac{t - t_f}{T_p - t_f}\right) \end{cases}$$

Parameters of the Rosenberg glottal pulse include the relative open duration ($t_f - t_o / T_p$) and the relative closed duration ($(T_p - t_f)/T_p$). By varying these ratios the timbral characteristics can be varied. In addition to this, the basic shape was modified to give the pulse a more natural quality. In particular, the mathematically defined shape was traced by hand (i.e. using a mouse with a paint program), leading to slight irregularities. The "dirtied waveform was then low-passed filtered using a 20-point finite impulse response (FIR) filter to remove sudden discontinuities introduced by the quantization of the mouse coordinates.

The pitch of the above glottal pulse is given by $T_p$. In our case, we wished to be able to flexibly use the same glottal pulse shape for different pitches, and to be able to control this continuously. This was accomplished by resampling the glottal pulse according to the desired pitch, thus changing the amount by which to hop in the waveform. Linear interpolation was used to determine the value of the glottal pulse at each hop.

The spectrogram of the glottal waveform was taken using a 1024 sample Hann window overlapped by 75%. The cross synthesis (702) between the periodic glottal pulse waveform and the speech was accomplished by multiplying (706) the magnitude spectrum (707) of each frame of the speech by the complex spectrum of the glottal pulse, effectively rescaling the magnitude of the complex amplitudes according to the glottal pulse spectrum. In some cases or embodiments, rather than using the magnitude spectrum directly, the energy in each bark band is used after pre-emphasizing (spectral whitening) the spectrum. In this way, the harmonic structure of the glottal pulse spectrum is undisturbed while the formant structure of the speech is imprinted upon it. We have found this to be an effective technique for the speech to music transform.

One issue that arises with the above approach is that un-voiced sounds such as some consonant phonemes, which are inherently noisy, are not modeled well by the above approach. This can lead to a "ringing sound" when they are present in the speech and to a loss of percussive quality. To better preserve these sections, we introduce a controlled amount of high passed white noise (708). Unvoiced sounds tend to have a broadband spectrum, and spectral roll-off is again used as an indicative audio feature. Specifically, frames that are not characterized by significant roll-off of high frequency content are candidates for a somewhat compensatory addition of high passed white noise. The amount of noise introduced is controlled by the spectral roll-off of the frame, such that unvoiced sounds that have a broadband spectrum, but which are otherwise not well modeled using the glottal pulse techniques described above, are mixed with an amount of high passed white noise that is controlled by this indicative audio feature. We have found that this leads to output which is much more intelligible and natural.

Song Construction, Generally

Some implementations of the speech to music songification process described above employ a pitch control signal which determines the pitch of the glottal pulse. As will be appreciated, the control signal can be generated in any number of ways. For example, it might be generated randomly, or according to statistical model. In some cases or embodiments, a pitch control signal (e.g., 711) is based on a melody (701) that has been composed using symbolic notation, or sung. In the former case, a symbolic notation, such as MIDI is processed using a Python script to generate an audio rate control signal consisting of a vector of target pitch values. In the case of a sung melody, a pitch detection algorithm can be used to generate the control signal. Depending on the granularity of the pitch estimate, linear interpolation is used to generate the audio rate control signal.

A further step in creating a song is mixing the aligned and synthesis transformed speech (output 710) with a backing track, which is in the form of a digital audio file. It should be noted that as described above, it is not known in advance how long the final melody will be. The rhythmic alignment step may choose a short or long pattern. To account for this, the backing track is typically composed so that it can be seamlessly looped to accommodate longer patterns. If the final melody is shorter than the loop, then no action is taken and there will be a portion of song with no vocals.

Variations for Output Consistent with Other Genres

We now describe further methods that are more suitable for transforming speech into "rap", that is, speech that has been rhythmically aligned to a beat. We call this procedure "AutoRap" and persons of ordinary skill in the art will appreciate a broad range of implementations based on the description herein. In particular, aspects of a larger computational flow (e.g., as summarized in FIG. 4 through functional or computational blocks such as previously illustrated and described relative to an application executing on a computing platform, recall FIG. 3) remain applicable. However, certain adaptations to previously described, segmentation and alignment techniques are appropriate for speech-to-rap embodiments. The illustration of FIG. 9 pertains to certain illustrative speech-to-rap embodiments.

As before, segmentation (here segmentation 911) employing a detection function is calculated using the spectral difference function based on a bark band representation. However, here we emphasize a sub-band from approximately 700 Hz to 1500 Hz, when computing the detection function. It was found that a band-limited or emphasized DF more closely corresponds to the syllable nuclei, which perceptually are points of stress in the speech.

More specifically, it has been found that while a mid-band limitation provides good detection performance, even better detection performance can be achieved in some cases by weighting the mid-bands but still considering spectrum outside the emphasized mid-band. This is because percussive onsets, which are characterized by broadband features, are captured in addition to vowel onsets, which are primarily detected using mid-bands. In some embodiments, a desirable weighting is based on taking the log of the power in each bark band and multiplying by 10, for the mid-bands, while not applying the log or rescaling to other bands.

When the spectral difference is computed, this approach tends to give greater weight to the mid-bands since the range of values is greater. However, because the L-norm is used with a value of 0.25 when computing the distance in the spectral distance function, small changes that occur across many bands will also register as a large change, such as if a difference of a greater magnitude had been observed in one, or a few, bands. If a Euclidean distance had been used, this effect would not have been observed. Of course, other mid-band emphasis techniques may be utilized in other embodiments.

Aside from the mid-band emphasis just described, detection function computation is analogous to the spectral difference (SDF) techniques described above for speech-to-song implementations (recall FIGS. 5 and 6, and accompanying description). As before, local peak picking is performed on the SDF using a scaled median threshold. The scale factor controls how much the peak has to exceed the local median to be considered a peak. After peak peaking, the SDF is passed, as before, to the agglomeration function. Turning again to FIG. 9, but again as noted above, agglomeration halts when no segment is less than the minimum segment length, leaving the original vocal utterance divided into contiguous segments (here 904).

Next, a rhythmic pattern (e.g., rhythmic skeleton or grid 903) is defined, generated or retrieved. Note that some embodiments, a user may select and reselect from a library of rhythmic skeletons for differing target raps, performances, artists, styles etc. As with phrase templates, rhythmic skeletons or grids may be transacted, made available or demand supplied (or computed) in accordance with a part of an in-app-purchase revenue model or may be earned, published or exchanged as part of a gaming, teaching and/or social-type user interaction supported.

In some embodiments, a rhythmic pattern is represented as a series of impulses at particular time locations. For example, this might simply be an equally spaced grid of impulses, where the inter-pulse width is related to the tempo of the current song. If the song has a tempo of 120 BPM, and thus an inter-beat period of 0.5 s, then the inter-pulse would typically be an integer fraction of this (e.g. 0.5, 0.25, etc.). In musical terms, this is equivalent to an impulse every quarter note, or every eighth note, etc. More complex patterns can also be defined. For example, we might specify a repeating pattern of two quarter notes followed by four eighth notes, making a four beat pattern. At a tempo of 120 BPM the pulses would be at the following time locations (in seconds): 0, 0.5, 1.5, 1.75, 2.0, 2.25, 3.0, 3.5, 4.0, 4.25, 4.5, 4.75.

Figure 9:
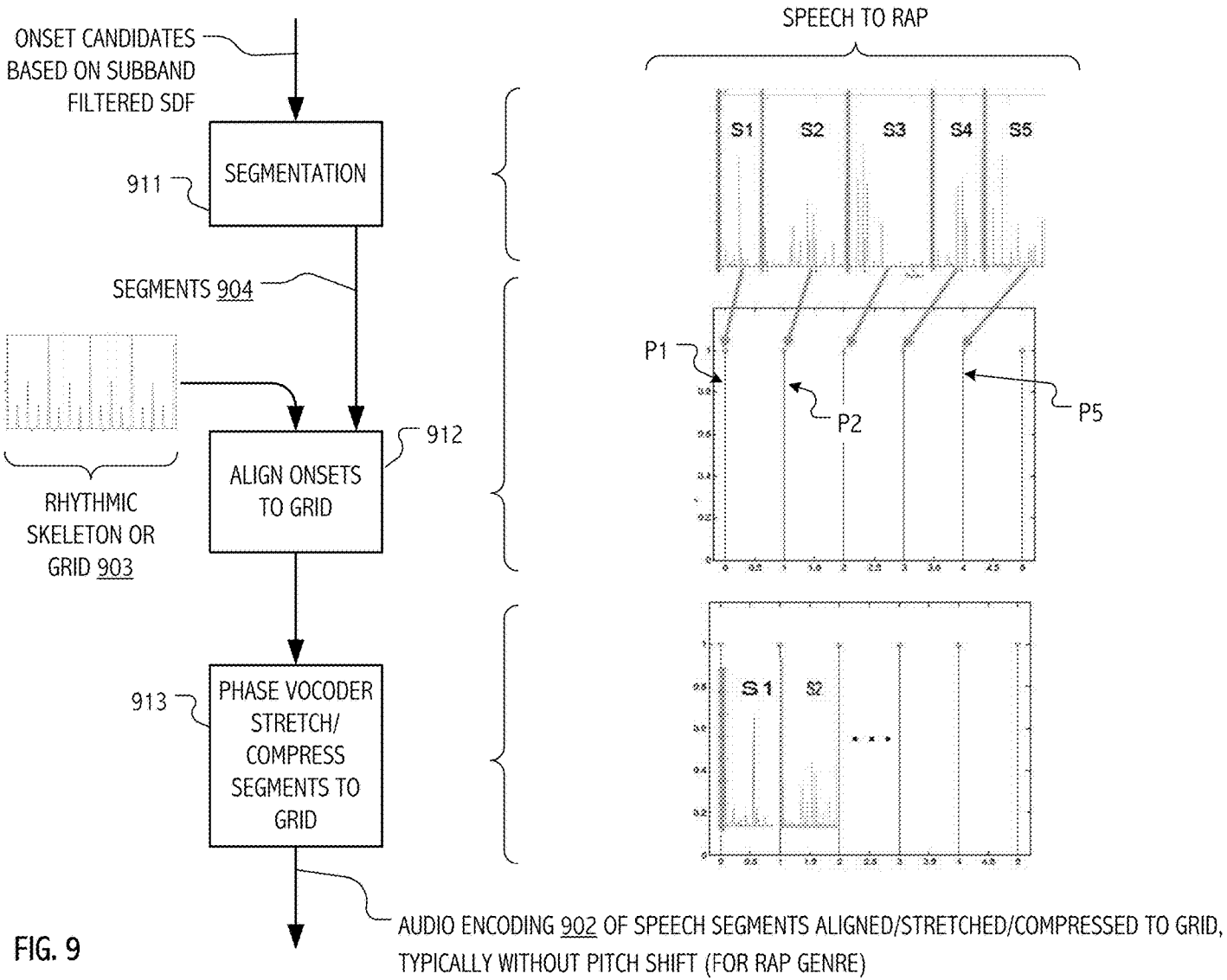
FIG. 9 illustrates, by way of a flowchart and a graphical illustration of segmentation and alignment, a sequence of steps in an illustrative method whereby onsets are aligned to a rhythmic skeleton or grid and corresponding segments of a segmented audio signal are stretched and/or compressed in accordance with some speech-to-rap targeted embodiments of the present invention(s).

After segmentation (911) and grid construction, alignment is (912) performed. FIG. 9 illustrates an alignment process that differs from the phrase template driven technique of FIG. 6, and which is instead adapted for speech-to-rap embodiments. Referring to FIG. 9, each segment is moved in sequential order to the corresponding rhythmic pulse. If we have segments S1, S2, S3 . . . S5 and pulses P1, P2, P3 . . . S5, then segment S1 is moved to the location of pulse P1, S2 to P2, and so on. In general, the length of the segment will not match the distance between consecutive pulses. There are two procedures that we use to deal with this:

The segment is time stretched (if it is too short), or compressed (if it is too long) to fit the space between consecutive pulses. The process is illustrated graphically in FIG. 9. We describe below a technique for time-stretching and compressing which is based on use of a phase vocoder 913.

If the segment is too short, it is padded with silence. The first procedure is used most often, but if the segment requires substantial stretching to fit, the latter procedure is sometimes used to prevent stretching artifacts.

Two additional strategies are employed to minimize excessive stretching or compression. First, rather than only starting the mapping from S1, we consider all mapping starting from every possible segment and wrapping around when the end is reached. Thus, if we start at S5 the mapping will be segment S5 to pulse P1, S6 to P2 etc. For each starting point, we measure the total amount of stretching/compression, which we call rhythmic distortion. In some embodiments, a rhythmic distortion score is computed as the reciprocal of stretch ratios less than one. This procedure is repeated for each rhythmic pattern. The rhythmic pattern (e.g., rhythmic skeleton or grid 903) and starting point which minimize the rhythmic distortion score are taken to be the best mapping and used for synthesis.

In some cases or embodiments, an alternate rhythmic distortion score, that we found often worked better, was computed by counting the number of outliers in the distribution of the speed scores. Specifically, the data were divided into deciles and the number of segments whose speed scores were in the bottom and top deciles were added to give the score. A higher score indicates more outliers and thus a greater degree of rhythmic distortion.

Second, phase vocoder 913 is used for stretching/compression at a variable rate. This is done in real-time, that is, without access to the entire source audio. Time stretch and compression necessarily result in input and output of different lengths—this is used to control the degree of stretching/compression. In some cases or embodiments, phase vocoder 913 operates with four times overlap, adding its output to an accumulating FIFO buffer. As output is requested, data is copied from this buffer. When the end of the valid portion of this buffer is reached, the core routine generates the next hop of data at the current time step. For each hop, new input data is retrieved by a callback, provided during initialization, which allows an external object to control the amount of time-stretching/compression by providing a certain number of audio samples. To calculate the output for one time step, two overlapping windows of length 1024 (nfft), offset by nfft/4, are compared, along with the complex output from the previous time step. To allow for this in a real-time context where the full input signal may not be available, phase vocoder 913 maintains a FIFO buffer of the input signal, of length 5/4 nfft; thus these two overlapping windows are available at any time step. The window with the most recent data is referred to as the "front" window; the other ("back") window is used to get delta phase.

First, the previous complex output is normalized by its magnitude, to get a vector of unit-magnitude complex numbers, representing the phase component. Then the FFT is taken of both front and back windows. The normalized previous output is multiplied by the complex conjugate of the back window, resulting in a complex vector with the magnitude of the back window, and phase equal to the difference between the back window and the previous output.

We attempt to preserve phase coherence between adjacent frequency bins by replacing each complex amplitude of a given frequency bin with the average over its immediate neighbors. If a clear sinusoid is present in one bin, with low-level noise in adjacent bins, then its magnitude will be greater than its neighbors and their phases will be replaced by that of the true sinusoid. We find that this significantly improves resynthesis quality.

The resulting vector is then normalized by its magnitude; a tiny offset is added before normalization to ensure that even zero-magnitude bins will normalize to unit magnitude. This vector is multiplied with the Fourier transform of the front window; the resulting vector has the magnitude of the front window, but the phase will be the phase of the previous output plus the difference between the front and back windows. If output is requested at the same rate that input is provided by the callback, then this would be equivalent to reconstruction if the phase coherence step were excluded.

Particular Deployments or Implementations

Figure 10:
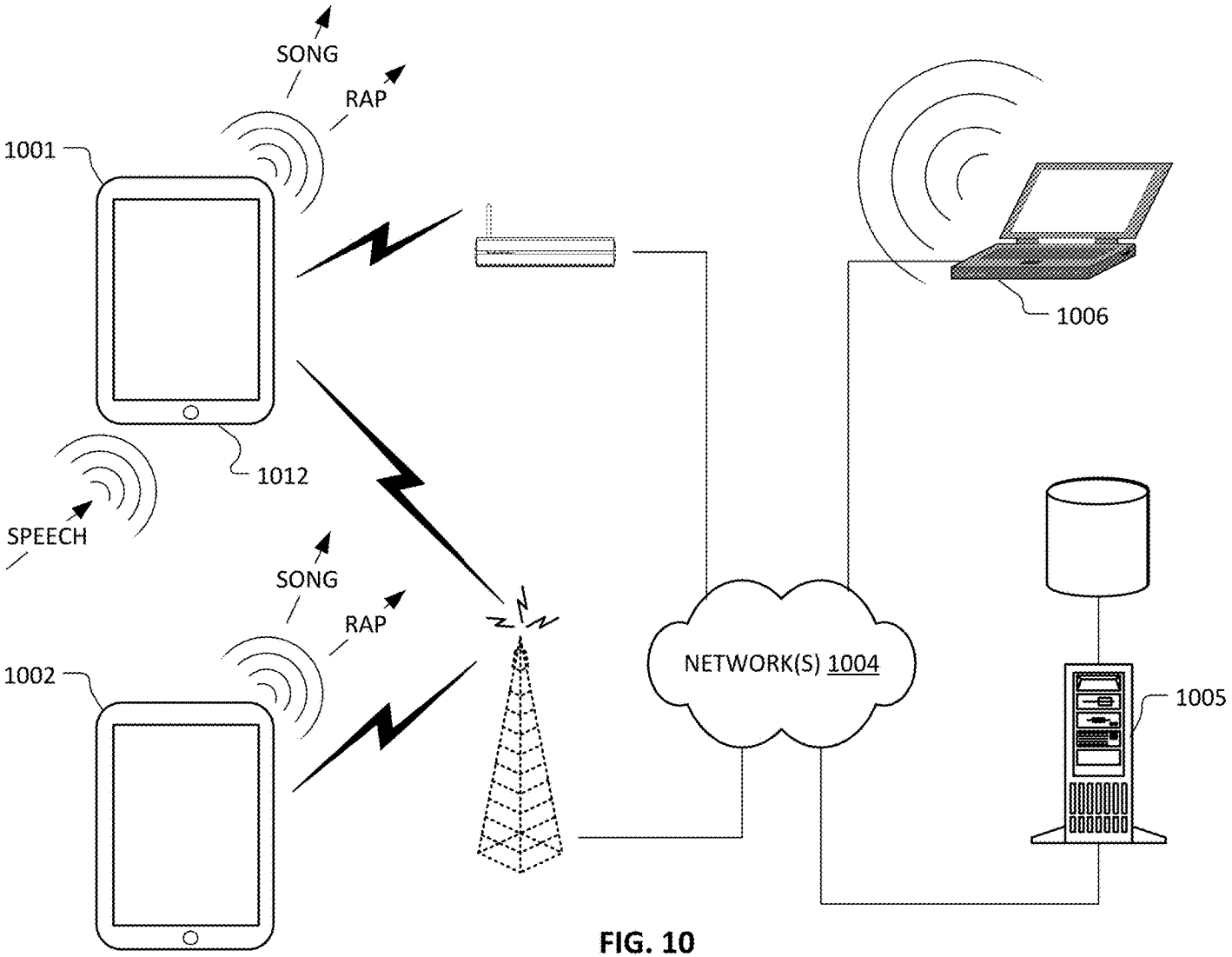
FIG. 10 illustrates a networked communication environment in which speech-to-music and/or speech-to-rap targeted implementations communicate with remote data stores or service platforms and/or with remote devices suitable for audible rendering of audio signals transformed in accordance with some embodiments of the present invention(s).

FIG. 10 illustrates a networked communication environment in which speech-to-music and/or speech-to-rap targeted implementations (e.g., applications embodying computational realizations of signal processing techniques described herein and executable on a handheld computing platform 1001) capture speech (e.g., via a microphone input 1012) and are in communication with remote data stores or service platforms (e.g., server/service 1005 or within a network cloud 1004) and/or with remote devices (e.g., handheld computing platform 1002 hosting an additional speech-to-music and/or speech-to-rap application instance and/or computer 1006), suitable for audible rendering of audio signals transformed in accordance with some embodiments of the present invention(s).

Figure 11:
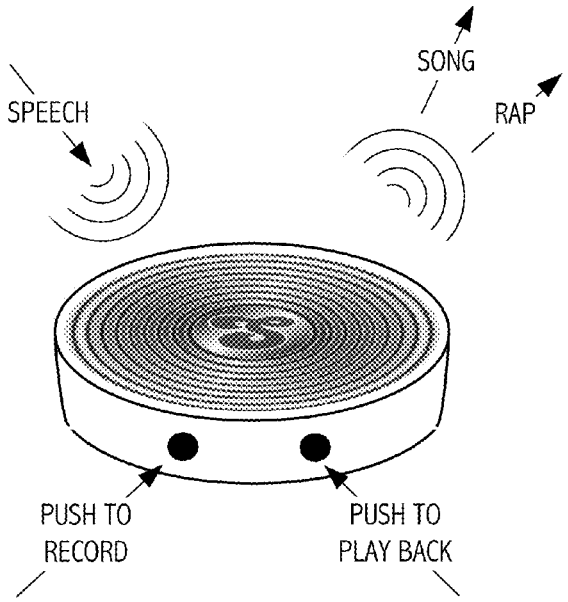
FIGS. 11 and 12 depict illustrative toy- or amusement-type devices in accordance with some embodiments of the present invention(s).
Figure 12:
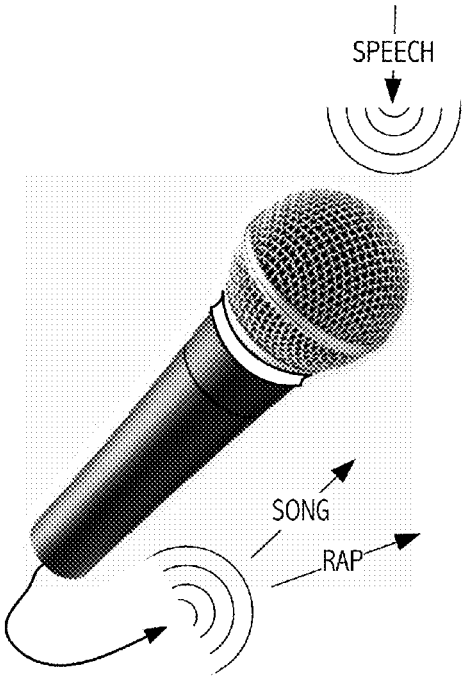
Figure 13:
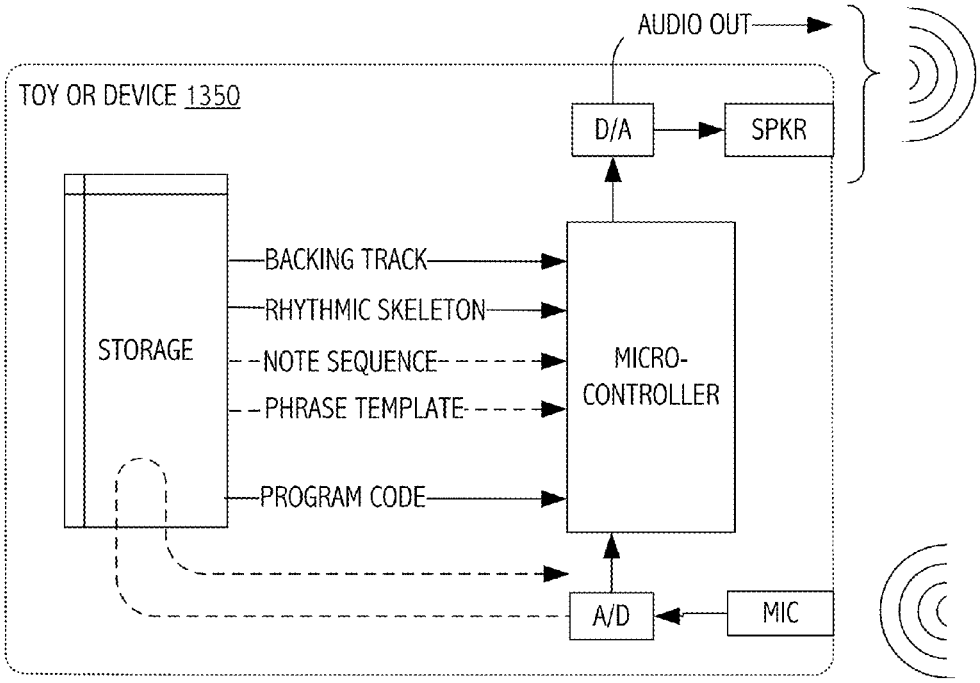
FIG. 13 is a functional block diagram of data and other flows suitable for device types illustrated in FIGS. 11 and 12 (e.g., for toy- or amusement-type device markets) in which automated transformation techniques described herein may be provided at low-cost in a purpose-built device having a microphone for vocal capture, a programmed microcontroller, digital-to-analog circuits (DAC), analog-to-digital converter (ADC) circuits and an optional integrated speaker or audio signal output.

Some embodiments in accordance with the present invention(s) may take the form of, and/or be provided as, purpose-built devices such as for the toy or amusement markets. FIGS. 11 and 12 depict example configurations for such purpose-built devices, and FIG. 13 illustrates a functional block diagram of data and other flows suitable for realization/use in internal electronics of a toy or device 1350 in which automated transformation techniques described herein. As compared to programmable handheld compute platforms, (e.g., iOS or Android device type embodiments), implementations of internal electronics for a toy or device 1350 may be provided at relatively low-cost in a purpose-built device having a microphone for vocal capture, a programmed microcontroller, digital-to-analog circuits (DAC), analog-to-digital converter (ADC) circuits and an optional integrated speaker or audio signal output.

Other Embodiments

While the invention(s) is (are) described with reference to various embodiments, it will be understood that these embodiments are illustrative and that the scope of the invention(s) is not limited to them. Many variations, modifications, additions, and improvements are possible. For example, while embodiments have been described in which vocal speech is captured and automatically transformed and aligned for mix with a backing track, it will be appreciated that automated transforms of captured vocals described herein may also be employed to provide expressive performances that are temporally aligned with a target rhythm or meter (such as may be characteristic of a poem, iambic cycle, limerick, etc.) and without musical accompaniment.

Furthermore, while certain illustrative signal processing techniques have been described in the context of certain illustrative applications, persons of ordinary skill in the art will recognize that it is straightforward to modify the described techniques to accommodate other suitable signal processing techniques and effects.

Some embodiments in accordance with the present invention(s) may take the form of, and/or be provided as, a computer program product encoded in a machine-readable medium as instruction sequences and other functional constructs of software tangibly embodied in non-transient media, which may in turn be executed in a computational system (such as a iPhone handheld, mobile device or portable computing device) to perform methods described herein. In general, a machine readable medium can include tangible articles that encode information in a form (e.g., as applications, source or object code, functionally descriptive information, etc.) readable by a machine (e.g., a computer, computational facilities of a mobile device or portable computing device, etc.) as well as tangible, non-transient storage incident to transmission of the information. A machine-readable medium may include, but is not limited to, magnetic storage medium (e.g., disks and/or tape storage); optical storage medium (e.g., CD-ROM, DVD, etc.); magneto-optical storage medium; read only memory (ROM); random access memory (RAM); erasable programmable memory (e.g., EPROM and EEPROM); flash memory; or other types of medium suitable for storing electronic instructions, operation sequences, functionally descriptive information encodings, etc.

In general, plural instances may be provided for components, operations or structures described herein as a single instance. Boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention(s).

What is claimed is:

1. A social music method comprising:

capturing, using an audio interface of a portable computing device, a raw vocal performance by a user of the portable computing device;

in an audio processing pipeline, computationally segmenting the raw captured vocal performance, wherein the segmenting results in a plurality of segments, and wherein each segment in the plurality satisfies a minimum segment length threshold such that a total number of segments in the plurality of segments is equal to or below a maximum number of segments;

temporally remapping segments of the segmented vocal performance; and generating from the temporal remapping a derived musical composition;

audibly rendering the derived musical composition at the portable computing device; and responsive to a selection by the user, causing a challenge to be transmitted to a remote second user, the challenge including an encoding of the derived musical composition and a seed including the user's raw captured vocal performance.

2. The method of claim 1, wherein the seed encodes the segmentation of the user's captured vocal performance.

3. The method of claim 1, further comprising:

receiving, for a vocal contribution of the remote second user captured in response to the challenge, a segmentation of the remote second user's vocal contribution; and from a combined segment set including at least some vocal segments captured from the user and at least some vocal segments captured from the remote second user, temporally remapping segments of the combined segment set and generating therefrom a derived musical composition including contributions of both the user and the remote second user.

4. The method of claim 3, wherein temporally remapping segments of the combined segment set and generating therefrom a derived musical composition including contributions of both the user and the remote second user utilizes fairness logic to ensure a level of balance in the derived musical composition amongst the contributions of the user and the remote second user.

5. The method of claim 1, further comprising:

receiving a vocal contribution of the remote second user captured in response to the challenge; and from a combined audio signal including at least some portions of the captured vocal performance of the user and at least some portions of the captured vocal contribution of the remote second user, computationally segmenting the combined audio signal;

temporally remapping the segments of the combined audio signal; and generating from the temporally remapped segments a derived musical composition including vocal content from both the user and the remote second user; and audibly rendering the derived musical composition at the portable computing device.

6. The method of claim 1, wherein the audio processing pipeline is implemented on the portable computing device.

7. The method of claim 1, wherein the audio processing pipeline is implemented, at least in part, on a service platform in data communication with the portable computing device.

8. A computer program product encoded in one or more non-transitory computer-readable media, the computer program product including instructions executable on a processor of the portable computing device to cause the portable computing device to perform or initiate the steps recited in claim 1.

9. A system comprising the portable computing device programmed with instructions executable on a processor thereof to cause the portable computing device to perform or initiate the steps recited in claim 1.

10. An audio processing pipeline implemented on a portable computing device comprising:

a segmentation stage for computationally segmenting at least a current vocal contribution captured in connection with a vocal performance battle, wherein the computational segmenting results in a plurality of segments, and wherein each segment in the plurality satisfies a minimum segment length threshold such that a total number of segments in the plurality of segments is equal to or below a maximum number of segments;

a partition mapping stage for temporally remapping segments from a combined segment set including at least some vocal segments captured from an initial user's seed performance and at least some vocal segments from one or more subsequent vocal contributors, including the current vocal contribution, captured in connection with the vocal performance battle, the initial user's seed performance including a raw captured vocal performance of the initial user; and further stages for generating from the temporal remapping, a derived musical composition including contributions of the initial user and one or more of the subsequent vocal contributors and for rendering the derived musical composition as an audio signal.

11. The audio processing pipeline of claim 10, wherein segmentations of a seed performance and of subsequent vocal contributions are introduced into the audio processing pipeline at, or before, the partition mapping stage for subsequent round audio processing.

12. The audio processing pipeline of claim 10, wherein the stages for generating from the temporal remapping a derived musical composition including contributions of the initial user and one or more of the subsequent vocal contributors utilizes fairness logic to ensure a level of balance in the derived musical composition amongst the contributions of the initial user and the subsequent vocal contributors.

* * * * *